United States Patent [19]

Delebecque et al.

[11] 3,996,700

[45] Dec. 14, 1976

[54] PROCESS AND APPARATUS FOR FINISHING MAGNETIC HALF-CORE MEMBERS OF THE POT-CORE TYPE

[75] Inventors: Robert Delebecque, Sceaux; André Jean Velte, Le Chesnay-Parly II, both of France

[73] Assignee: Societe Anonyme de Telecommunications, Paris, France

[22] Filed: Nov. 7, 1975

[21] Appl. No.: 629,920

[30] Foreign Application Priority Data

Nov. 27, 1974 France ..... 74.38835

[52] U.S. Cl. ..... 51/3; 51/327; 198/813; 198/820

[51] Int. Cl.[2] ..... B24B 15/00; B24B 1/00

[58] Field of Search ..... 51/3, 76 R, 138, 156, 51/157, 327; 198/131, 193, 160, 201

[56] References Cited

UNITED STATES PATENTS

| | | | |
|---|---|---|---|
| 1,936,991 | 11/1933 | Pinkney | 51/138 X |
| 3,120,892 | 2/1964 | Henning | 198/201 X |
| 3,310,161 | 3/1967 | Kraft | 198/193 |
| 3,847,271 | 11/1974 | Culley | 51/76 R |

FOREIGN PATENTS OR APPLICATIONS

| | | | |
|---|---|---|---|
| 597,513 | 11/1944 | United Kingdom | 51/156 |

*Primary Examiner*—Harold D. Whitehead
*Assistant Examiner*—Nicholas P. Godici
*Attorney, Agent, or Firm*—William R. Woodward

[57] ABSTRACT

A finishing process for magnetic half-core members of the pot core type, comprising a base, a cylindrical part and a central annular part. The half-core members are carried by a belt moving past at least one machining apparatus, the half-core members are placed in the belt such that, in the machining apparatus, the cylindrical part moves against two parallel fixed abrasive surfaces, between which is disposed an abrasive cylinder, which projects with respect to said abrasive surfaces, in order to machine simultaneously the central annular part, whereby an air gap is formed when two half-core members are assembled.

11 Claims, 16 Drawing Figures

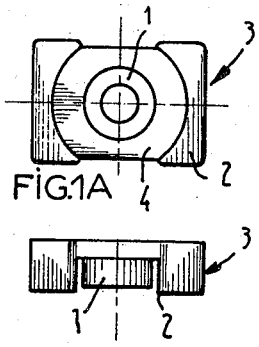
FIG.1A
FIG.1B
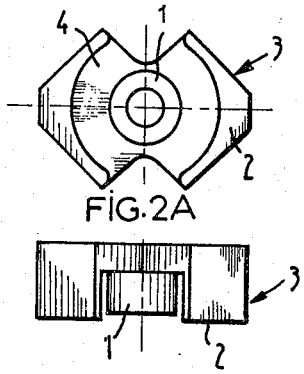
FIG.2A
FIG.2B
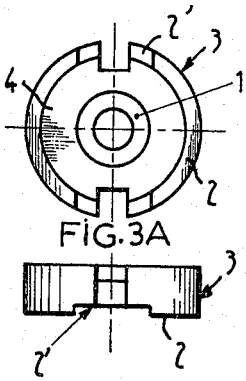
FIG.3A
FIG.3B
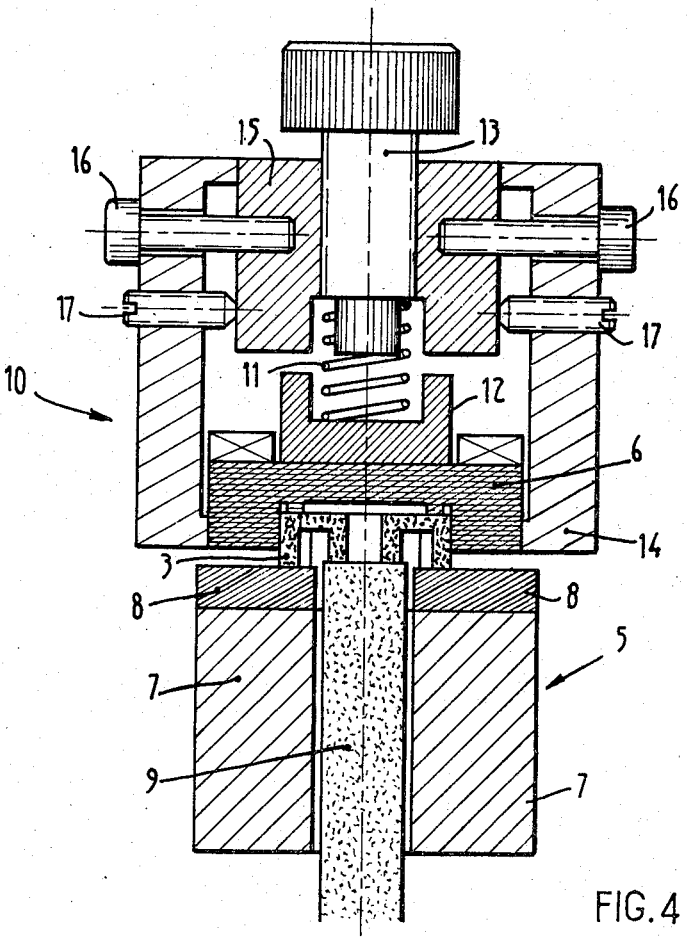
FIG.4

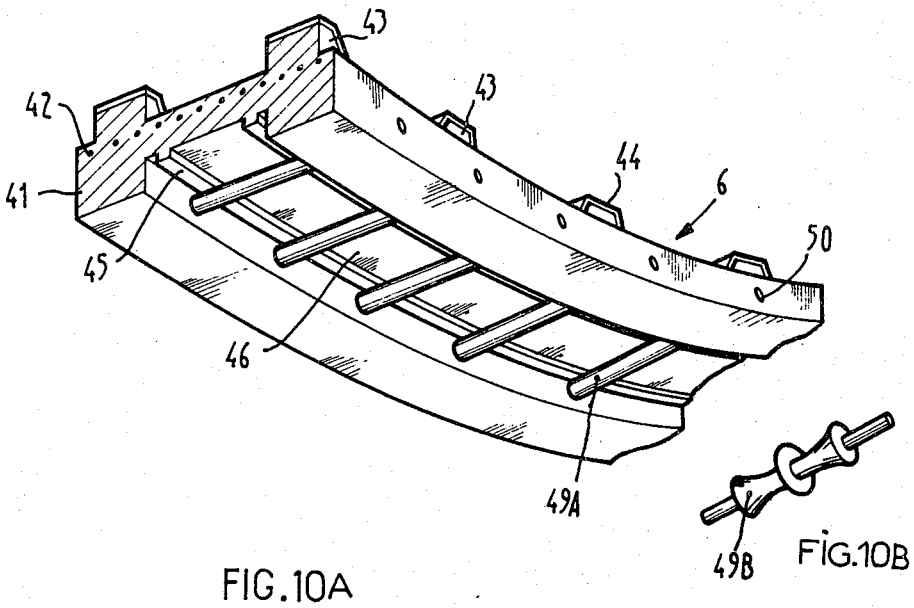
FIG.10A
FIG.10B
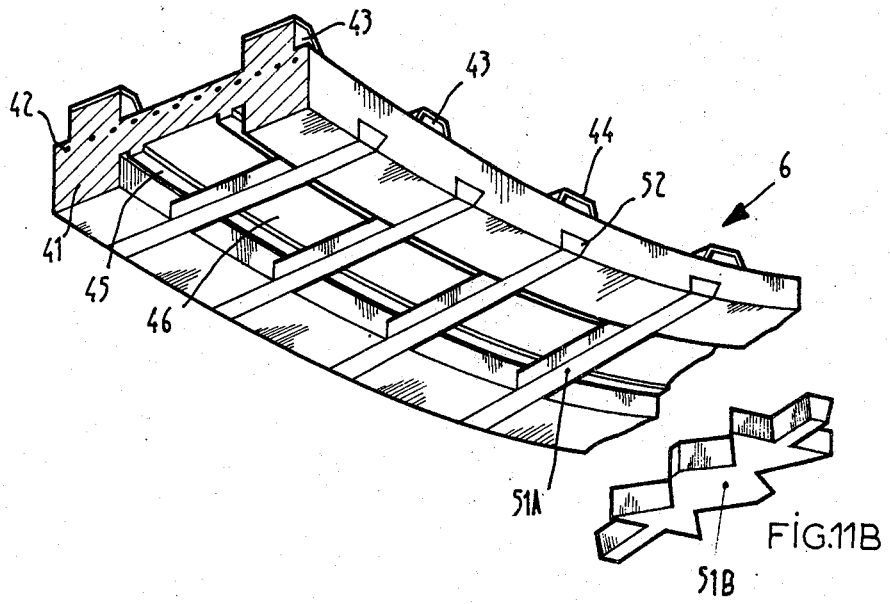
FIG.11A
FIG.11B

PROCESS AND APPARATUS FOR FINISHING MAGNETIC HALF-CORE MEMBERS OF THE POT-CORE TYPE

The invention concerns a process and an apparatus for the finishing of magnetic half-core members of the pot core type having on their open side lateral edges which require grinding in order that the edges of two half-core members may be assembled with perfect fit, and having an annular central part which is machined, in particular by means of an abrasive cylinder, in order to achieve a precision air-gap when two half-core members are assembled.

Magnetic core assembly of the pot-core type of this kind are used in large quantities in the production of telecommunication equipment. In fact, the telecommunications industry uses in large quantities inductances formed by placing one or more appropriate coils in a cavity created by assembling two magnetic ferrite half core members. The precise value of these inductances is generally adjusted by means of a final operation in which, by means of a known process, a magnetic adjuster member is screwed into the magnetic core assembly and penetrates to a greater or lesser degree into the air-gap.

To render this adjustment possible, the effective permeability of the casing has to be adjusted within precise limits, by machining the air-gap existing between the central annular surfaces of the two parts assembled to create a magnetic assembly of the pot type.

As described in the French Pat. No. 2,184,386, a device for adjusting the air-gap in these magnetic assemblies is known. In this arragement, a half core-member is placed in a device which is able to assume a low position to bring the air-gap of the half-core member in contact with a grinder, and at least one high position in which the half-core member is separated from the grinder and its electrical properties are measured, the cycle of grinding/measuring being repeated until the desired results are obtained.

However, such an arrangement has several disadvantages, these being its complexity, the fact that it is possible to machine only one half-core member at a time and above all that it is not possible to grind simultaneously the edges of the magnetic half-core member to obtain a perfect fit of these half-core members, so that this grinding has to be carried out either before or after the adjusting of the air-gap.

This invention proposes to eliminate these disadvantages by means of a finishing process for the above kind of magnetic half-core members, in which the parts to be machined are borne on a belt moving continuously past at least one tool owing to the fact that the half-core members are carried along in such a way that the open side, with appropriate pressure applied to the base of the half-core members, moves along two parallel fixed surfaces, each having an abrasive coating and serving to machine the lateral edges, and between which is placed an abrasive cylinder which projects in relation to the aforesaid surfaces for the machining of the lateral edges, in order to machine the air-gap at the same time to the appropriate dimensions.

The device for realisation of the invented process comprises at least one machining apparatus consisting of at least one abrasive tool, that is a grinder, past which the parts to be machined move continuously, and it is characterised by the fact that it consists of two parallel fixed rails of defined length, each having an abrasive coating and spaced apart to correspond substantially to the diameter of the central annular section of the half-core members and serving to grind the edges of the half-core members; in addition, there is a grinder located between the aforesaid rails and rotating about a horizontal axis perpendicular to the rails, so that the surface of the grinder projects in relation to the plane of the rails to permit simultaneous machining of the central annular part, the half-core members being placed on an endless belt so that their open side faces the said rails whilst a device of appropriate pressure keeps the half-core members engaged on the belt in contact with the aforesaid rails and grinder.

The invention, therefore, allows simultaneous machining of a large number of half-core member, in respect of the air-gap and the lateral edges.

In accordance with a prefered form of the invention, the device for finishing the magnetic half-core members comprises at least two machining apparatus arranged one after the other, the first in the direction of movement of the half-cores, for rough grinding, whilst the second carries out the finishing.

According to another characteristic of the invention, the planes of the abrasive coatings on the rails and on the grinder are individually adjustable in relation to each other.

In accordance with a further characteristic of the invention, the belt consists of a plastic material moulded around a longitudinal armature made of metallic or textile cables, and has on one face projection and/or indented mouldings allowing it to move without slipping on cylinders of corresponding profile, and is characterised by the fact that it has on the other face a channel whose profile corresponds to that of the half-core members to be machined, and whose base has raised parts in elastic material intended to compensate for the slight dimensional differences existing between the half-core members and to transmit the pressure applied to the other face of the belt to the solid parts of the half-core members.

In another version, inserts are mounted into the sides of the belt, transversely in relation to the said channel, so as to make individual recesses within the latter.

Before adjusting air-gaps in accordance with this invention, the half-core members, or parts to be machined are grouped in homogeneous batches, same powder pressing batch, same oven batch. This allows a single air-gap dimension to be achieved for all pieces of the same batch and this with great precision since the dimensional tolerances obtained with the invention are less than one micron.

The principal advantage of the invention lies in the fact that it makes it possible to attain an excellent uniformity of machining together with a high rhythm of production.

The present invention will be better understood with the help of the following description of a particular form of realisation given by way of example and represented on the attached diagram in which:

FIGS. 1A, 1B, 2A, 2B and 3A, 3B represent different known shapes of magnetic ferrite half-core members of the pot type.

FIG. 4 is a transverse section representing the layout of the principal elements of the device in accordance with the invention.

FIGS. 7, 8, 9, 10A, 10B and 11A, 11B show some examples of design of the belt used in accordance with the invention.

FIGS. 1A, 1B, 2A, 2B, 3A and 3B show, in plan and elevation, half-core members 3 of known type.

Figure 5:
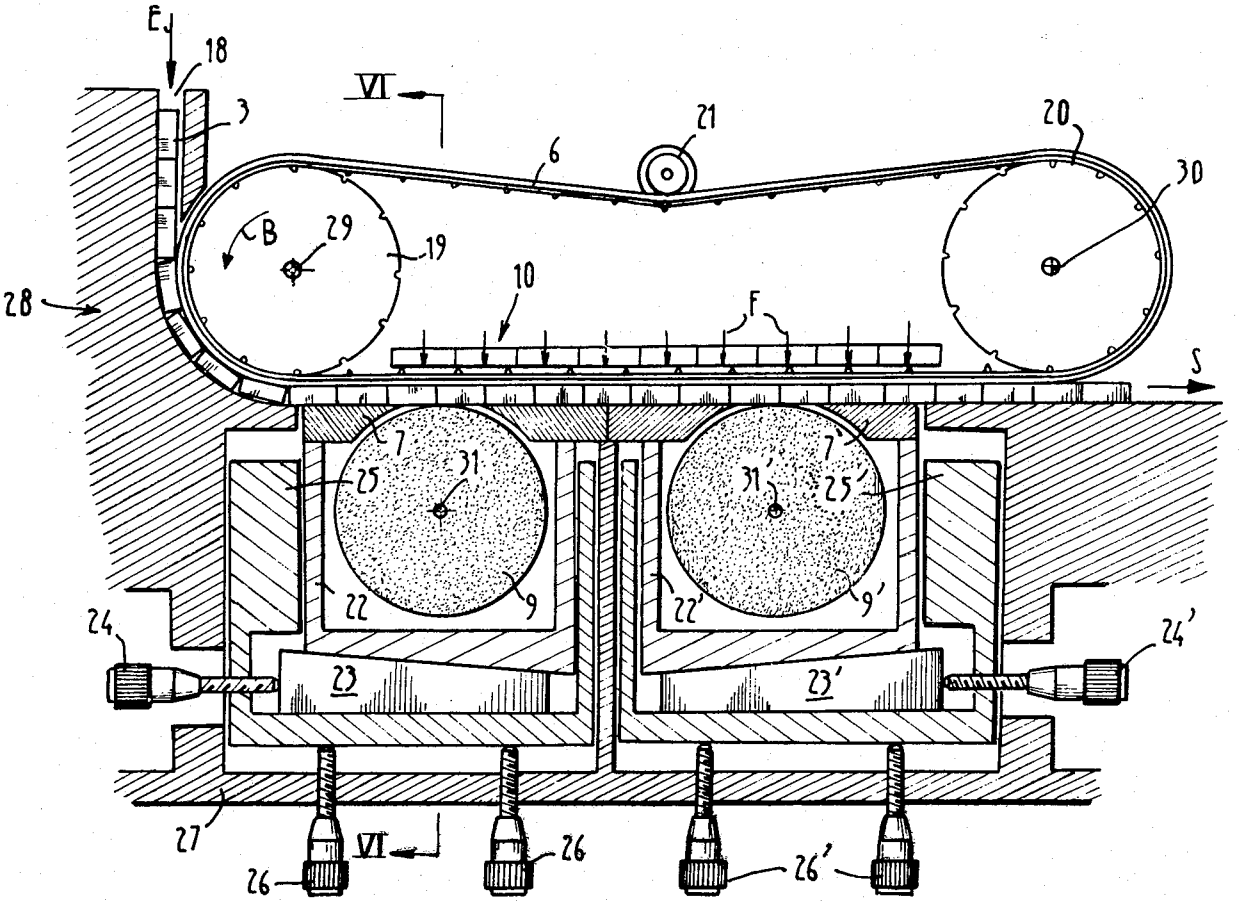
FIG. 5 represents a longitudinal section of the device in accordance with the invention.

As seen in these figures, the half-core members may have different shapes and they comprise a base 4 and, on the open side, lateral edges or meeting faces 2, which have to be ground in order to ensure an exact fit of the two half-core members, and also an annular central part 1 which must be machined in order to define a air-gap air-grip when the two half-core member 3 are assembled. It will be noticed in FIGS. 3A and 3B that the grinding of the annular central part 1 in accordance with the invention creates a supplementary lateral opening 2', whereas in the case of the half-core members shown in FIGS. 1A, 1B and 2A, 2B the existing lateral opening is adequate to allow passage of the grinder.

FIG. 4 shows the relative positions of the principal elements of a machining apparatus in the device for realisation of the invention. The half-core members 3 are engaged in an elastic belt 6 so that the open side of the half-core members 3 is facing the machining apparatus, which is indicated as a whole by the reference number 5. The machining apparatus 5 is essentially made up of two parallel fixed rails 7, each bearing a slightly abrasive coating 8, and an abrasive cylinder or grinder 9 which rotates about a horizontal axis situated in the plane of the diagram and not represented here. The space between the two rails 7 is at least equal to the diameter of the annular central part 1 of the half-core members 3. The abrasive coating 8 on the rails, which has a very good geometric definition, is intended to perfect the quality of surface of the meeting faces or edges 2 of the magnetic half-core members 3. By way of example, this coating may be achieved either by deposit of alumina attained by hot spraying, or by means of finely surfaced small plates of alumina which are then stuck onto the rails, or by deposit of a diamond particle layer. The purpose of the grinder 9 is to machine the annular central part 1 of the half-core members in order to form an air-gap when the two half-core members are assembled. The grinder is a diamond covered grinder and has a relatively large diameter so that work load is distributed over a large number of diamonds in order to reduce to a negligeable level the effect of wear during several weeks of use. The aforesaid grinder 9 is mounted on a precision pin of known type.

The elastic belt 6, which may be for instance in neoprene, serves mainly as a means of transporting the parts to be machined from the entrance to the exit of the device, and to transmit to these parts the pressure exerted by pressure devices such as that indicated in its entirety by reference 10. As shown diagramatically in FIG. 5, several of these pressure devices 10 are provided along the length of a machining point. Such a pressure device 10 is essentially made up of a pressure element or spring 11 acting on the inside face of the belt 6, through an element 12 in the shape of a dish. The force F (represented diagramatically by an arrow in FIG. 5) exerted by the spring can be regulated by means of a screw 13. The belt 6 ensures likewise the lateral guiding of the parts to be machined 3 above the machining point 5. The lateral guiding rods 14, fixed on the unit 15 in which the screw 13 is mounted, and whose lower ends rest on parts of the belt, allow a pinching of the parts 3 through pressure on the sides of the belt 6, by acting on the pressure screws 16 and the adjustable stop screws 17.

Turn now to FIG. 5 which shows a longitudinal section of the device according to the invention. In the form represented by way of example, this device comprises two machining apparatus of similar construction.

In this figure, the parts which are identical to those in FIG. 4 are indicated by the same references.

The half-core members to be machined 3 are introduced into the device from the left of the figure as shown by the arrow E, by a channel 18 fed by an automatic device of known type, not shown on the figure.

The parts are moved down by gravity and are taken up by the belt 6 mounted on two cylinders 19,20 turning on shafts 29,30 respectively, and whose circumference contains grooves corresponding to the pins or teeth on the inside face of the belt, as will be seen in greater detail later. The device rotating these cylinders is not represented.

The tension of the belt 6 is governed in classical manner by a strainer pulley 21.

The half-core members 3 to be machined are held on the belt 6 by means which will be described in detail later, and are carried level with the machining apparatus.

Given that the two machining points are of identical construction, the corresponding elements of the second machining point will be indicated by the same references as for the first machining apparatus with the addition of an index number, and the two apparatus will be described at the same time.

The first machining apparatus in the direction of movement of the belt indicated by the arrow 8, is used for example for the rough grinding, whilst the second undertakes the finishing. The number of apparatus is not limited, and there could equally well be a single apparatus or more than two.

The rails 7,7' whose abrasive coating 8,8' is not shown in this figure, are fixed to regulating devices 22,22' each attached to a micrometric movement device of known type comprising a block with an inclined surface 23,23' which can be moved horizontally by means of a precision regulating screw 24,24'.

The regulating device 22,22' and each attached block 23,23' are housed in a case 25,25' whose vertical position can also be adjusted by means of micrometric screws 26,26'. These micrometric screws 26,26' traverse the base 27 of a structure which is represented diagramatically and indicated in its entirety by the reference 28, and they press on the base of a case 25,25' in order to vary respectively the horizontal position of each block unit 23,23'-regulating device 22,22' and, through this fact, the positon of the rails 7,7' in order to ensure continuity between the planes on which the parts to be machined move, and to regulate the parallelism and when necessary the relative position of the rails 7,7' and of the plane of the grinders 9,9'.

The grinders 9,9' are situated within the regulating devices 22,22' and are rotated by the shafts 31,31'. These grinders are mounted in a fixed position, and, as explained above, it is the position of the rails 7,7' which can be adjusted in relation to the plane of the grinders.

At the end of the machining process, the half-core members are withdrawn on the right of the figure following the arrow S towards a receiving device of known type which is not shown.

Figure 6:
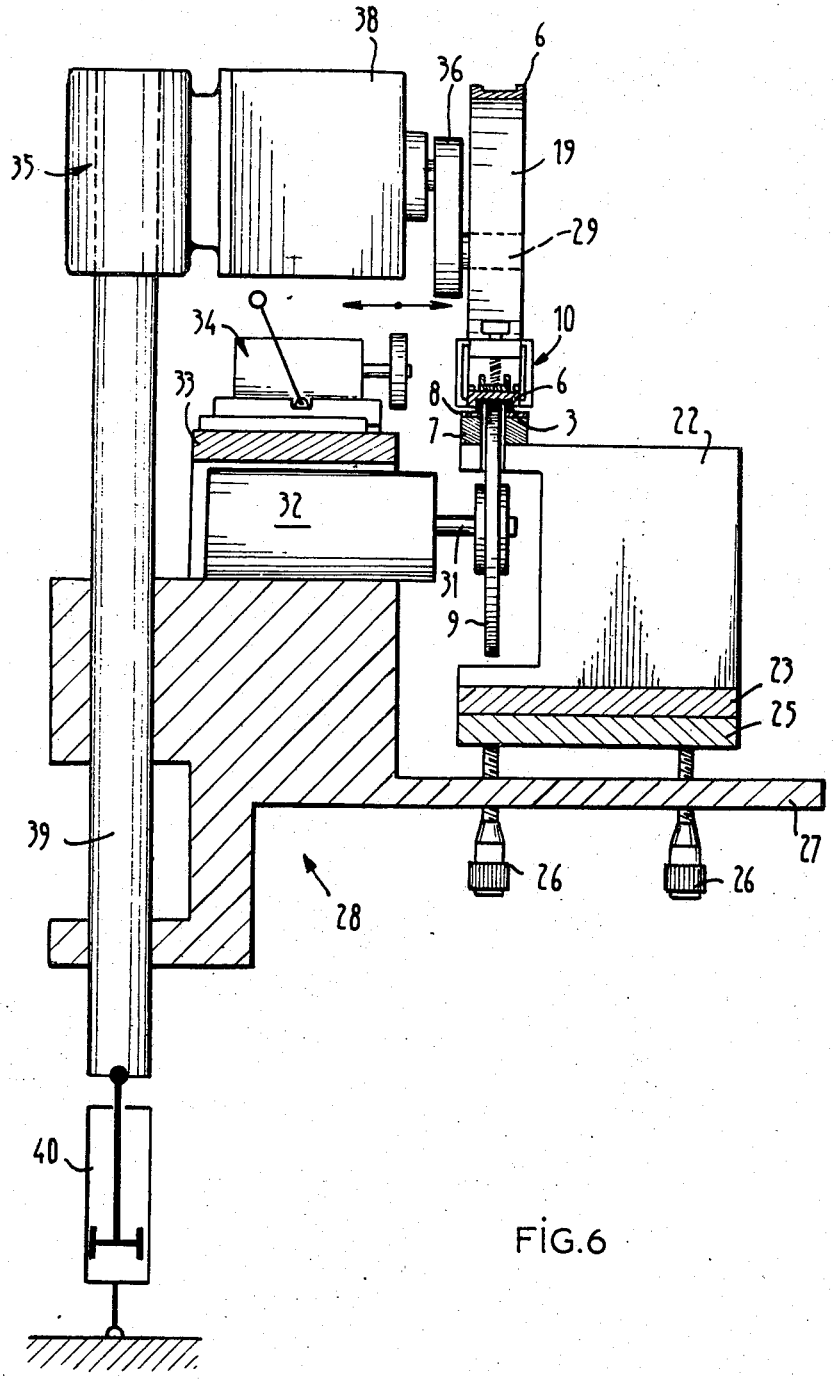
FIG. 6 represents a transverse section along the line VI—VI in FIG. 5.

FIG. 6 is a cross sectional view along the line VI—VI in FIG. 5. Identical parts are indicated by the same reference. In this figure will be seen the belt 6 mounted on the cylinder 19 and applying the half-core members 3 to the abrasive coating 8 of the rails 7, by means of a pressure device 10 shown in simplified manner.

The rails 7 are mounted on a regulating device 22 the position of which may be adjusted by means of the block 23, the screws 26 and also a screw 24, not visible on this figure.

The shaft 31 of the grinder 9 is rotated at an appropriate speed by means of a known device, for example by means of a precision pin 32 driven by a motor which is not shown. In addition, a horizontal reference plane 33, is specified, on which is fixed a trimming device 34 for the touching up of the working surface of the grinders in order to attain perfection of the cylindrical, concentric and parallel qualities of the generator for the grinders 9,9', with this plane reference 33. The trimming device 34 is of known type and will not be described in detail.

The shaft 29 of the cylinder 19 is rotated by means of an appropriate device 35, comprising for example a motor unit 38 and a drive belt 36.

This drive device 35 is integral with a column 39 sliding vertically in the case 28, through the action of a jack 40. This mobile arrangement allows the working points to be disengaged for adjustments and cleaning when necessary.

There now follows a description of the belt 6 with reference to FIGS. 7 to 11, which are views in perspective of a section of different models of belt which may be used in accordance with the invention. These types are given only as examples and are not limiting.

The basic structure of the belt used according to the invention remains the same for the various forms of belt realised.

This belt 6 consists essentially of a continuous ribbon 41 of elastic material, such as neoprene, made by moulding around an armature.

This armature is, for example, made of a sheet of metallic or textile cables 42 which are bedded in the mass of the belt. At the point of union of the cables in order to form an endless belt, the extremities of the aforesaid cables are positioned side by side for a certain length in order to avoid a weakening of the mechanical strength. The said armature may also be formed by means of a single cable wound spirally.

The inside face of the belt 6, that is the upper face in FIGS. 7 to 11, has teetn or pins 43 intended to work together with the toothed cylinders 19,20 for nonslip drive of the belt. To strengthen this toothing, each tooth or pin 43 is covered with a metallic casing 44 fixed to the elastic material by known processes.

The outside face of the belt which is the lower face in FIGS. 7 to 11, varies according to the outside shape of the half-core members to be machined. Nevertheless, in all cases there is a channel 46 at the base of which are raised parts 45 for the purpose of pressing on the bottom of the split casings, on the large parts of these, in order to keep the half-core members in contact with the abrasive surfaces of the machining apparatus. These raised parts 45 which are an integral part of the belt and are, in consequence, made of elastic material also serve to compensate for the small dimensional differences existing between the mass produced half-core members.

Figure 7:
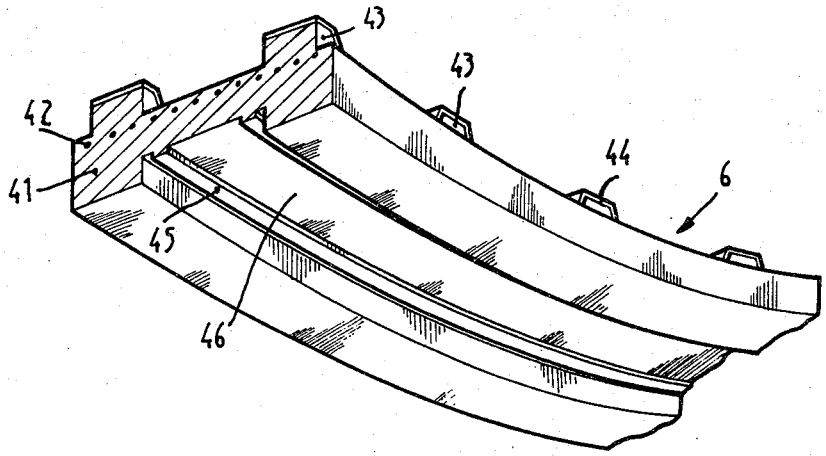

FIG. 7 shows a belt intended in particular to carry magnetic half-core members of a general rectangular shape such as that shown in FIG. 1. With this type of belt, the half-core members are placed directly one against the other.

Figure 8:
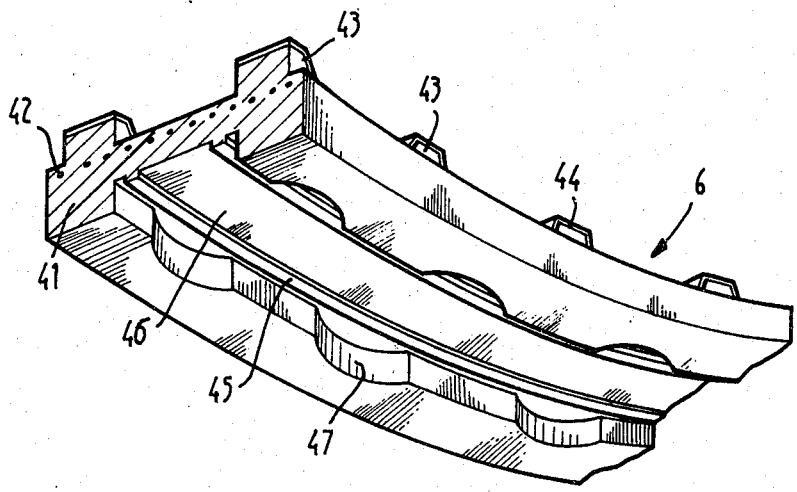

FIG. 8 shows a belt intended in particular to carry magnetic half-core members such as that shown in FIG. 3, that is of a generally circular shape. To facilitate the transport and relative immobilisaton of the half-core members in relation to the belt, the edges of the chanel 46 have grooves 47 in the form of an arc of a circle corresponding to the shape of the half-core members. The half-core members 3 which are moved down by gravity into the channel 18 (FIG. 5) are then deposited in succession in the individual slots thus formed.

Figure 9:
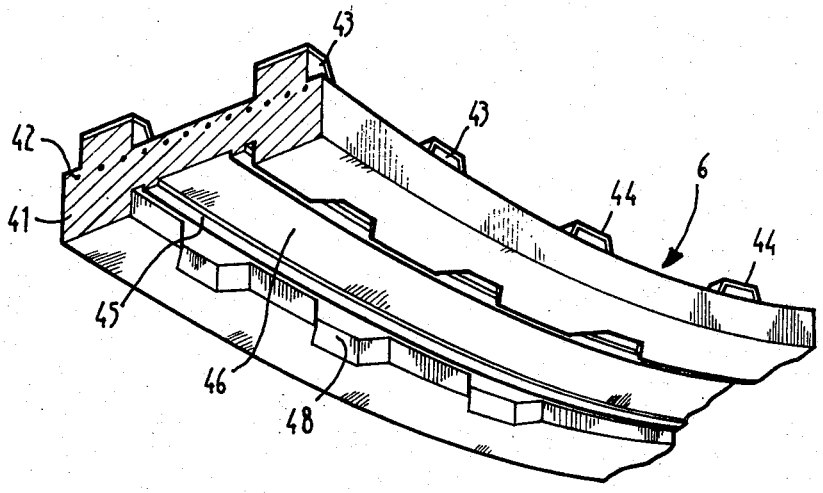

FIG. 9 shows a belt intended in particular to carry half-core members 3 such as that shown in FIG. 2. This belt also has individual slots formed by the grooves 48, the shape of which corresponds to that of the lateral edges of the half-core members, these grooves being made in the edges of the channel 46.

FIG. 10A shows a belt 6 suitable for instance to the transport of half-core members of a general rectangular shape, but on which the half-core members are not pressing one against another but are placed in individual slots formed by the transverse units 49 A, the ends of which are inserted into holes 50 pierced in the sides of the belt. These transverse units 49A may be metallic units or units moulded from plastic material.

The shape of these units is dependent upon the shape of the half-core members carried, and FIG. 10B shows one variation of such a unit, which is indicated in this figure by the reference 49B.

FIG. 11A shows a variation of the FIG. 10A, in which the inserted units, indicated by the reference 51A, are no longer fitted into holes pierced in the sides of the belt but are fitted and/or glued into recesses 52 cut into the sides of the belt. FIG. 11B shows one variation 51B of such a unit. These units likewise form individual slots adapted to receive the different shapes of half-core members likely to be carried by the aforesaid belt.

Naturally, the different types of belt shown are not limiting and the width of the channel 46 as well as the dimensions and shape of the individual slots are selected according to the dimensions and shape of the half-core members required to be machined.

We claim:

1. A finishing process for magnetic half-core members of the pot core type, having, on the open side lateral edges requiring to be ground in order to obtain perfect fit of these edges when two half-core members are assembled, and having also a central annular part which is machined, in particular by means of an abrasive cylinder, in order to define an exact air-gap when two half-core members are assembled; the process comprising the following steps:

a. the parts to be machined are carried by a belt moving continuously past at least one tool; and b. the half-core members are carried in such a way that the open side, with appropriate pressure on the base of the half-core members, moves against two parallel fixed surfaces, each having an abrasive coating, serving to machine the lateral edges, and between which is located an abrasive cylinder which projects in relation to the aforesaid surfaces for the machining of the lateral edges, said half-core members moving against said cylinder in order to machine simultaneously the air-gap to appropriate dimensions.

2. Finishing apparatus for finishing magnetic half-core members, having an open side with lateral edges, and having a central annular part comprising:

at least one machining apparatus;

at least one abrasive tool means at said machining apparatus past which the parts to be machined move continuously;

two parallel fixed rail means, of defined length, each having an abrasive coating, the space between them corresponding closely to the diameter of the central annular part of the half-core members and serving to grind the edges of the half-core members;

grinder means placed between the aforesaid rail means and turning about a horizontal axis perpendicular to the rail means, in such a way that the surface of the grinder projects in relation to the plane of the aforesaid rail means to allow simultaneous machining of the central annular part;

endless belt means whereon the half-core members are positioned so that their open side is turned towards the aforesaid rail means;

and means for applying appropriate pressure to keep the half-core members engaged on the belt in contact with the aforesaid rail means and the aforesaid grinder means.

3. Apparatus as claimed in claim 2, wherein at least two machining apparatus are placed one after the other, the first, in the direction of movement of the half-core members, being used for rough grinding whilst the second is used for finishing.

4. Apparatus as claimed in claim 2, wherein the planes of the abrasive coatings of the rail means and of the grinder means are individually adjustable and adjustable in relation to each other.

5. Apparatus as claimed in claim 3, wherein the planes of the abrasive coatings of the rail means and of the grinder means are individually adjustable and adjustable in relation to each other.

6. Apparatus as claimed in claim 2, in which the belt means comprises plastics material moulded around a longitudinal aramature made of metallic or textile cables, and has on one face projecting and/or indented mouldings permitting non-slip drive on cylinders of corresponding profile, and the said belt means has on the other face a channel whose profile corresponds to that of the half-core members to be machined, and the base of which has raised parts in elastic material for the purpose of compensating for the slight dimensional differences existing between the half-core members and of transmitting the pressure exerted on the other face of the belt means to the large parts of the aforesaid half-core members.

7. Apparatus as claimed in claim 6, wherein inserted units are fitted into the sides of the belt means, transversely in relation to the said channel, in such a way as to form individual slots within the latter.

8. Apparatus as claimed in claim 3, in which the belt means comprises plastics material moulded around a longitudinal armature made of metallic or textile cables, and has on one face projecting and/or indented mouldings permitting non-slip drive on cylinders of corresponding profile, and the said belt means has on the other face a channel whose profile corresponds to that of the half-core members to be machined, and the base of which has raised parts in elastic material for the purpose of compensating for the slight dimensional differences existing between the half-core members and of transmitting the pressure exerted on the other face of the belt means to the large parts of the aforesaid half-core members.

9. Apparatus as claimed in claim 8, wherein inserted units are fitted into the sides of the belt means, transversely in relation to the said channel, in such a way as to form individual slots within the latter.

10. Apparatus as claimed in claim 4, in which the belt means comprises plastics material moulded around a longitudinal armature made of metallic or textile cables, and has on one face projecting and/or indented mouldings permitting non-slip drive on cylinders of corresponding profile, and the said belt means has on the other face a channel whose profile corresponds to that of the half-core members to be machined, and the base of which has raised parts in elastic material for the purpose of compensating for the slight dimensional differences existing between the half-core members and of transmitting the pressure exerted on the other face of the belt means to the large parts of the aforesaid half-core members.

11. Apparatus according to claim 10, wherein inserted units are fitted into the sides of the belt means, transversely in relation to the said channel, in such a way as to form individual slots within the latter.

* * * * *